United States Patent [19]

Justice

[11] Patent Number: 4,927,292

[45] Date of Patent: May 22, 1990

[54] HORIZONTAL DEWATERING SYSTEM

[76] Inventor: Donald R. Justice, P.O. Box 458, Matlacha, Fla. 33909

[21] Appl. No.: 324,700

[22] Filed: Mar. 17, 1989

[51] Int. Cl.[5] ..... E02B 11/00

[52] U.S. Cl. ..... 405/43; 405/174; 405/129

[58] Field of Search ..... 405/43, 45, 39, 48; 166/101, 106, 187

[56] References Cited

U.S. PATENT DOCUMENTS

| | | | |
|---|---|---|---|
| 2,949,861 | 8/1960 | Heath | 166/106 |
| 3,876,000 | 4/1975 | Nutter | 166/106 |
| 4,167,358 | 9/1979 | Besha | 405/87 |
| 4,180,348 | 12/1979 | Taylor | 405/43 X |
| 4,372,389 | 2/1983 | Hamrick et al. | 166/106 X |
| 4,391,551 | 7/1983 | Belcher | 405/43 |

*Primary Examiner*—Randolph A. Reese

*Assistant Examiner*—Arlen L. Olsen

*Attorney, Agent, or Firm*—Fleit, Jacobson, Cohn, Price, Holman & Stern

[57] ABSTRACT

Water is removed from an underground perforated pipe by a submersible pump inserted into an imperforate pipe extending from above ground to below ground level for communication with the perforated pipe. An inflatable bladder seals the submersible pump to the inner wall of the imperforate pipe for facilitating suction of water from the perforated pipe into the imperforate pipe. Water is drawn into a proximal end of the pump and expelled out of a distal end of a pump, and out of the imperforate pipe above ground level. By sealing the pump to the inner wall of the imperforate pipe, the pump is capable of drawing water from an underground perforated pipe located at a depth greater than the pumping capacity of the pump for drawing up water.

6 Claims, 3 Drawing Sheets

HORIZONTAL DEWATERING SYSTEM

FIELD OF THE INVENTION

This invention is related to a method and apparatus for lowering the water table by evacuating a length of buried horizontal well pipe through a vertically extending header.

BACKGROUND OF THE INVENTION

It is known that at a construction site or along a proposed path of underground utility lines, it is necessary to lower the water table level. One method for lowering the water table is the use of horizontal well pipe. The well pipe is placed at the bottom of a trench and then backfilled with the excavated earth or with substitute fill conveyed to the trench. A suction pump is attached at an above-ground end of the pipe to continuously draw up water that enters perforations in a horizontal portion of the well pipe until the water table is lowered.

The pump located above-ground is capable of pumping the water up to the ground level from a certain depth according to the capacity of the pump. However, conventional pumps have a limited suctioning capability for drawing up water. Typically, the average limit is on the order of 18 feet of water through a certain diameter pipe. Therefore, in situations where it is necessary to remove water from an underground pipe located at a depth greater than 18 feet, it is inefficient for above-ground pumps to draw up water.

SUMMARY OF THE INVENTION

Horizontal dewatering perforated pipe is laid at the bottom of a trench by a trenching machine, as disclosed in applicant's co-pending application Ser. No.07/153,441, filed Feb. 8, 1988, now U.S. Pat. No. 4,871,281, which is hereby incorporated by reference. By the present invention, a pump is placed in a bottom portion of an imperforate header section connected to the buried horizontal perforated pipe to pump water up from below ground. A discharge port is provided at the proximal end of the pump and a suction port is provided at a distal end of the pump.

The pump may include an inflatable bladder surrounding the pump. The inflatable bladder is expanded around the pump casing to engage with the interior surface of the imperforate pipe for sealing off the pipe and creating a vacuum in the pipe below the suction port. Furthermore, the inflatable sealing bladder surrounds the pump casing between the proximal and distal ends to isolate the suction port from the discharge port.

When the pump is energized, water is sucked up and out of the underground perforated pipe via the suction port and is expelled through the discharge port into an imperforate pipe portion or header located above the pump. The discharged water accumulates in the pipe above the discharge port and eventually is pumped to an outflow opening in the pipe which is located above ground level. The inflatable sealing bladder may be attached to or form a part of the submersible pump assembly, or alternatively may take the form of an inflatable jacket which the submersible pump is inserted into prior to insertion into the pipe.

It is also advantageous to use the present system and method to recycle irrigation water on a farm. Water used to irrigate crops passes through the soil and carries with it many of the nutrients and fertilizers used to cultivate the crops. By burying extended lengths of perforated pipe at a suitable depth below the soil, the water is collected by the sections of perforated pipe as it seeps through the soil and is drawn up by the pump located at the bottom of the imperforate header section so as to recycle the irrigation water for additional irrigational purposes. The nutrients carried away by the irrigation water are thereby captured and prevented from descending to the water table, where certain of the chemicals applied to the crops may produce a potential health hazard if continuously leeched into the water supply.

Additionally, the present system and method may be used at landfill sites by burying extended lengths of perforated pipe at the base of a landfill prior to its use. As the refuse and other landfill material is deposited into the landfill, rainwater and other water applied to the refuse material to lower the risk of fire is captured by the perforated pipe as it descends through the ground. The descending water is captured within the perforated sections of pipe and pumped through the imperforate header section by a pump located at the junction of the imperforate and perforate pipe sections to pump the water up and back onto the landfill, where a portion of the water will evaporate and a portion, again, will pass through the landfill material to the perforated pipe sections. This continuous recycling of contaminated water prevents the water from ultimately descending to the water table and contaminating the water supply.

It is a primary object of the present invention to provide a system for pumping water with a pump from an underground pipe located at a depth typically greater than the above-ground pumping capabilities of the pump.

It is an additional object of this invention to provide a system for removing water from an underground well discharge pipe through the use of a pump inserted inside pipe and locating the pump proximate to an underground perforated pipe portion of the well discharge pipe, and having an inflatable bladder for sealing off a portion of the pipe below the pump adjacent the underground perforated pipe portion, thereby creating a vacuum for increasing the pumping capacity and efficiency of the pump.

It is yet another object of the present invention to provide a system for removing water from an underground discharge pipe which includes an imperforate pipe portion extending from above ground level to the underground discharge pipe portion, including a submersible pump assembly for insertion into the imperforate pipe portion and for positioning the pump adjacent the underground discharge pipe at a perforated pipe portion.

The above objects and advantages will become more apparent when reference is made to the following description taken in conjunction with the accompanying drawings.

DETAILED DESCRIPTION OF THE PREFERRED EMBODIMENTS

Figure 1:
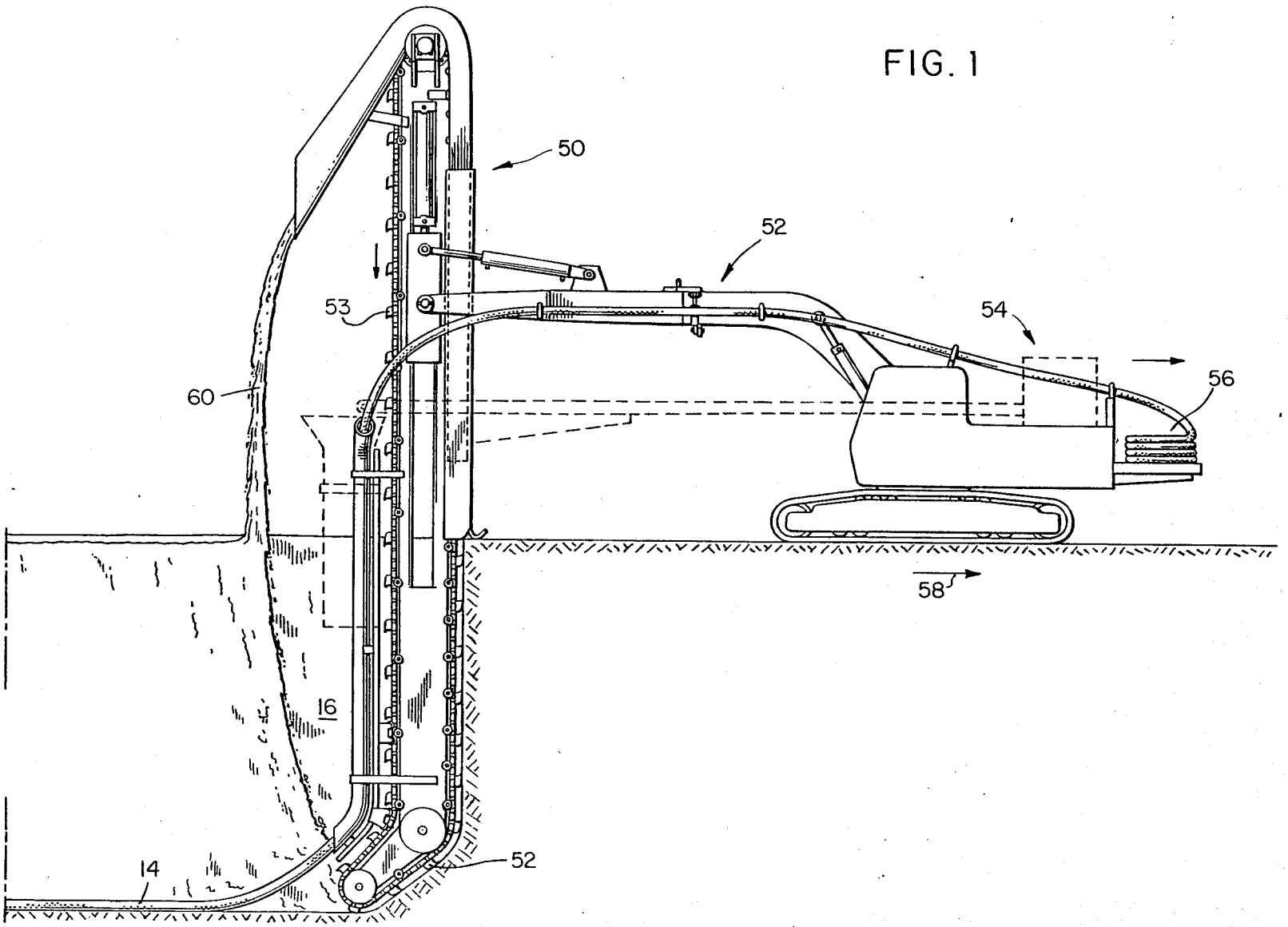
FIG. 1 is a schematic diagram of a trenching tool digging a trench, laying perforated pipe at the bottom of the trench, and backfilling the trench to cover the perforated pipe.

In describing a preferred embodiment of the invention illustrated in the drawings, specific terminology will be used for the sake of clarity. However, the invention is not intended to be limited to the specific terms selected, and it is to be understood that each specific term includes all technical equivalents which operate in a similar manner to accomplish a similar purpose.

In FIG. 1, trenching tool 50 is shown mounted on an end of a boom 52, which is connected to tractor 54. The trenching tool 50 includes a series of cutting blades 53 mounted on an endless conveyor to dig a trench 16 along a path desired to introduce a horizontal dewatering pipe to lower the water table or to collect water as it descends through the earth. Along the bottom of the trench is laid a perforated drain pipe 14, which is fed from a supply reel 56 on the tractor 54 to feed the perforated pipe as the tractor moves in the direction of arrow 58. One end of the pipe 14 is sealed which is initially buried in the trench. The opposite terminal end is open for connection to an imperforate pipe, as will be explained later.

The trench 16 is backfilled to ground level by the soil 60, previously removed to form the trench, or by additional fill conveyed to the trench.

After a sufficient length of imperforate pipe 14 has been buried at the bottom of the trench, the imperforate pipe is cut, and the terminal end 62 of the perforated pipe 14 is connected to an imperforate T-coupling 64 at one end 66. Another end 68 of the coupling is sealed. The third opening 70 of the T-coupling is connected to imperforate discharge pipe or header 12, which extends from an above ground discharge 72 to the end 70 of the T-coupling 64. The opposite open end 62 of the perforated pipe is connected to end 66 of T-coupling 64 to provide communication between the imperforate pipe 12 and the perforated pipe 14.

Imperforate discharge pipe or header 12 is of a corrugated configuration having inner wall 13, the purpose of which will be explained hereinafter.

Figure 3:
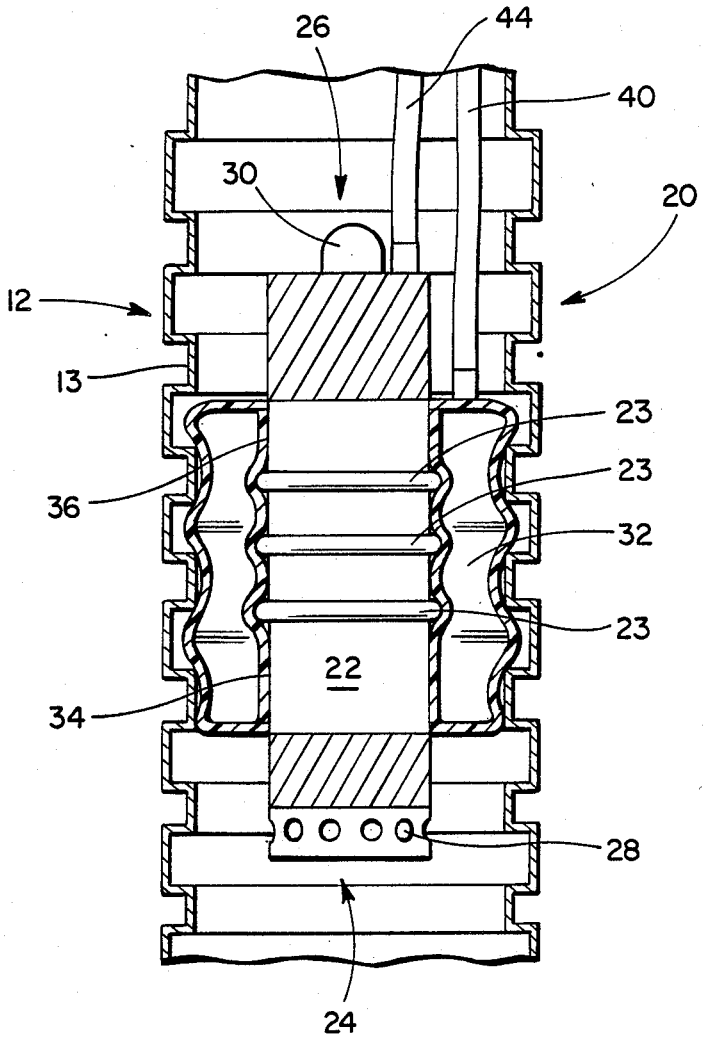
FIG. 3 is an enlarged sectional view taken through line 3—3 of FIG. 2.

Water removal system 10 includes a submersible pump assembly 20, shown in detail in FIG. 3. Pump assembly 20 includes a pump 22 having a distal end 24 and a proximal end 26. Pump 22 includes a suction port 28 located at the distal end 24, and a discharge port 30 located at the proximal end 26.

In addition, pump assembly 20 includes an annular inflatable bladder 32 for sealing the annular region between the pump and the discharge pipe 12. Rings 23 are provided around the pump 22 for engaging with the bladder 32. Preferably, bladder 32 is securely attached to pump 22 at flat end surfaces 34 and 36, adjacent the distal and proximal ends 24 and 26, respectively. The bladder 32 is expanded by air pressure to frictionally conform around rings 23 for further sealing to the pump 22.

Alternatively, bladder 32 can take the form of an expandable jacket which is not attached to the pump 22. In this case, the pump 22 is inserted into the jacket, and rings 23 assist in holding the jacket on and around the pump 22 in position.

Figure 2:
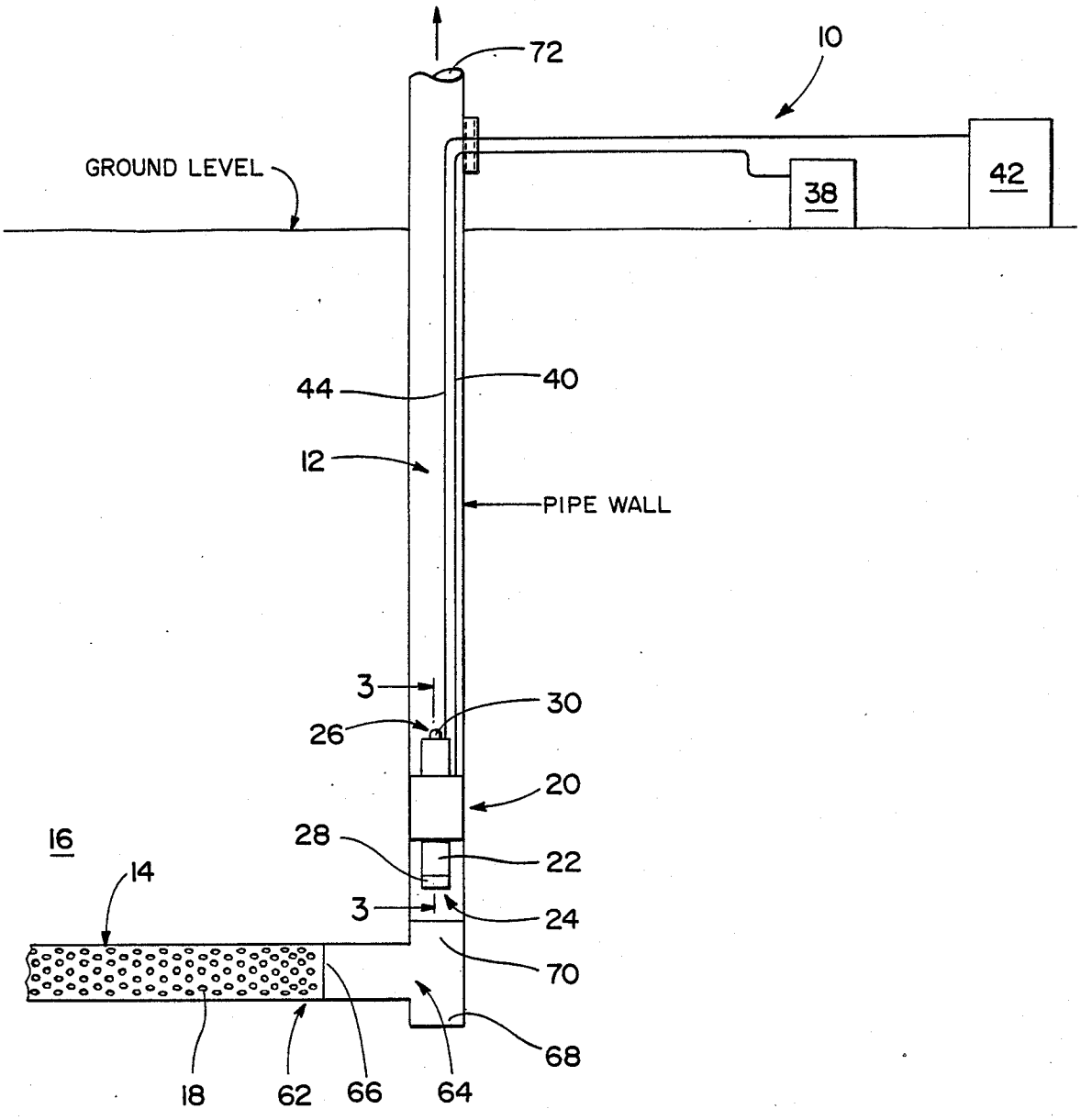
FIG. 2 is a schematic diagram illustrating the water removal system of the present invention, including perforated pipe laid in conjunction with the trenching tool and connected to an imperforate header.

In operation, pump assembly 20 is inserted into discharge pipe 12 and positioned proximate to the terminal end 62 of perforated pipe portion 14, as illustrated in FIG. 2. A source of air pressure 38 is provided above-ground and connected to the inflatable bladder 32 via a flexible tubing 40. The bladder 32 is thereby inflated and sealed in position around pump 22. In addition, a source of electrical energy 42 is provided above-ground and connected to pump 22 via insulated cable 44.

Once the pump assembly 20 is in position, bladder 32 is inflated sufficiently by air pressure to firmly engage and surround pump 22 and also engage the corrugated inner wall 13 of imperforate pipe 12. In this way, the annular opening between pipe 12 and pump 22 is sealed, and a vacuum is created in pipe 12 below suction port 28 to allow imperforate pipe portion 12 to be utilized as a discharge pipe. Furthermore, by sealing the pump 22 inside imperforate pipe 12, and creating a vacuum in pipe 12 below the suction port 28 and adjacent to the source of water to be pumped, the pumping efficiency of pump 22 is increased.

After the pump 22 is sealed in pipe 12, suction is applied through port 28 to remove water entering the perforated pipe 14. As water is drawn up, the pump expels the water out of the discharge port 30. Water is then forced above the proximal end of pump 26 and is finally expelled out of an open discharge end 72 of pipe 12 above ground level. Since the pump 22 is lowered to approximately a distance less than its rated capacity above the perforated drain portion containing the water, the pumping capacity of pump 22 is easily handled and prolongs the life of pump 22. Therefore, such a system as described herein can employ standard pump devices, but further their capabilities for removing water at greater depths.

The above description is intended by way of example only, and is not intended to limit the present invention in any way except as set forth in the following claims.

I claim:

1. A system for removing water from an underground pipe located at a predetermined depth below ground level, said system comprising:

a perforated pipe extending horizontally in a continuous direction for a substantial distance buried in a trench for seepage of water into said perforate pipe, one end of said perforated pipe being sealed and an opposite end of said perforated pipe being open, an imperforate pipe extending vertically from above ground level and being in communication with said open end of said perforated pipe, said imperforate pipe including a discharge outlet located above ground level, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, and energy means for powering said pump so that a vacuum is created to draw water into said suction port of said pump from said perforated pipe, discharged out of said discharge port of said pump to said proximal end of said pump, pumped through a portion of said imperforate pipe located above said pump and expelled out of said discharge outlet of said imperforate pipe above ground level.

2. The system of claim 1, further comprising a source of air connected to said sealing means, and said sealing means including an inflatable bladder securely attached to and surrounding said pump between said distal and proximal ends of said pump, said inflatable bladder being expandable upon supply of air from said source of air for firmly engaging an outer surface of said pump between said proximal and distal ends, and for firmly engaging said inner wall of said imperforate pipe.

3. The system of claim 1, further comprising a source of air connected to said sealing means, and said pump further including a plurality of sealing rings surrounding said pump, and said sealing means comprises an inflatable jacket, said pump being inserted into said jacket and firmly engaging an outer surface of said pump via said sealing rings, said inflatable jacket being expandable upon supply of air from said source of air for firmly engaging said inner wall of said imperforate pipe.

4. The system of claim 1, wherein a length of said inner wall of said imperforate pipe located below ground level is formed of corrugations, said corrugations facilitating sealing of said sealing means to said inner wall of said imperforate pipe.

5. A method for removing water from underground, said method comprising the steps of:

digging a horizontally elongated trench, locating a length of perforated pipe at the bottom of said trench, covering said length of perforated pipe, connecting a length of imperforate pipe to said perforated pipe, said imperforate pipe extending from above ground to said imperforate pipe located below ground, inserting a submersible pump into and within said imperforate pipe, said submersible pump having a proximal discharge port and a distal suction port, positioning said submersible pump in said imperforate pipe with said suction port being proximate said perforated pipe, energizing said submersible pump, creating a vacuum below said pump to draw water into said suction port of said pump from said perforated pipe and expelling water out of said discharge port of said submersible pump into said imperforate pipe, and expelling water out of said imperforate pipe above ground level.

6. The system of claim 5, further comprising sealing said pump to an interior of said imperforate pipe.

* * * * *